US009431754B2

(12) United States Patent
Lee et al.

(10) Patent No.: US 9,431,754 B2
(45) Date of Patent: Aug. 30, 2016

(54) ELECTRICAL CONNECTOR STRUCTURE CAPABLE OF REDUCING RELATIVE MOVEMENT BETWEEN SIGNAL MODULES

(71) Applicant: Advanced-Connectek Inc., New Taipei (TW)

(72) Inventors: Kuo-Ching Lee, New Taipei (TW); Ya-Ping Liang, Tian-Jin (CN); Ruei-Si Hong, New Taipei (TW); Chih-Chieh Chang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/687,981

(22) Filed: Apr. 16, 2015

(65) Prior Publication Data

US 2015/0303618 A1 Oct. 22, 2015

(30) Foreign Application Priority Data

Apr. 21, 2014 (CN) ..... 2014 1 0159074

(51) Int. Cl.

| | |
|---|---|
| ***H01R 13/648*** | (2006.01) |
| ***H01R 13/506*** | (2006.01) |
| *H01R 13/514* | (2006.01) |
| *H01R 13/6585* | (2011.01) |
| *H01R 13/6586* | (2011.01) |
| *H01R 12/50* | (2011.01) |
| *H01R 13/518* | (2006.01) |
| *H01R 13/6587* | (2011.01) |

(52) U.S. Cl.

CPC ..... *H01R 13/506* (2013.01); *H01R 13/514* (2013.01); *H01R 13/518* (2013.01); *H01R 13/6585* (2013.01); *H01R 13/6586* (2013.01); *H01R 13/6587* (2013.01); *H01R 23/688* (2013.01)

(58) Field of Classification Search

USPC ..... 439/607.05

See application file for complete search history.

(56) References Cited

U.S. PATENT DOCUMENTS

| | | | | |
|---|---|---|---|---|
| 6,743,057 | B2 | 6/2004 | Davis et al. | |
| 7,674,133 | B2 * | 3/2010 | Fogg | H01R 23/688 439/108 |
| 8,382,520 | B2 * | 2/2013 | Ritter | H01R 12/724 439/541.5 |

* cited by examiner

*Primary Examiner* — Tho D Ta

(74) *Attorney, Agent, or Firm* — Alan D. Kamrath; Kamrath IP Lawfirm, P.A.

(57) ABSTRACT

An electrical connector structure includes a housing and signal modules mounted therein. Each signal module includes an insulating body, conductive terminals and a ground shield. The insulating body has a first side having a guide projection, and a second side opposite to the first side and having a guide groove. When a first signal module has been mounted in the housing, a second signal module is guided and moved to mount into the housing by the guide groove of the second signal module receiving the guide projection of the first signal module, or by the guide projection of the second signal module sliding into the guide groove of the first signal module, whereby reducing relative movement between signal modules in the housing. The signal modules may be mounted one by one in the housing, or may be stacked side by side and then mounted in the housing as a whole.

18 Claims, 9 Drawing Sheets

ELECTRICAL CONNECTOR STRUCTURE CAPABLE OF REDUCING RELATIVE MOVEMENT BETWEEN SIGNAL MODULES

BACKGROUND OF THE INVENTION

1. Field of the Invention

The present invention relates to an electrical connector structure and, more particularly, to an electrical connector structure capable of reducing relative movement between signal modules mounted in a housing.

2. Description of the Prior Art

U.S. Pat. No. 6,743,057 discloses an electrical connector which is called a ZD connector in the industry. The electrical connector includes a female (or receptacle) connector. The female connector structure includes a housing and a plurality of signal modules. The signal modules are stacked side by side and mounted in the housing. Each of the signal modules includes an insulating body, a plurality of conductive terminals, and a ground shield, wherein each of the conductive terminals is disposed in the corresponding insulating body, and the ground shield is mounted on one side of the corresponding insulating body so that one ground shield is positioned between conductive terminals of two adjacent signal modules to reduce signal crosstalk. The patent further discloses a metal tie bar for retaining the signal modules in place relative to one another to reduce relative movement between the signal modules mounted in the housing. However, additionally employing the metal tie bar increases production cost. Moreover, if the number of the signal modules increases or decreases, the length of the present metal tie bar doesn't conform thereto, and new metal tie bars of different lengths are needed, resulting in increased production and management costs.

SUMMARY OF THE INVENTION

The present invention is adapted to providing an electrical connector structure capable of reducing relative movement between signal modules mounted in a housing without additional metal tie bars.

According to an aspect of the present invention, there is provided an electrical connector structure including a housing and a plurality of signal modules mounted therein. Each of the signal modules includes an insulating body, a plurality of conductive terminals, and a ground shield. The insulating body has a first side and a second side opposite thereto, wherein the first side has a guide projection, and the second side has a guide groove. The conductive terminals are disposed in the insulating body. The ground shield is mounted on the first side or the second side of the insulating body. Moreover, the signal modules include a first signal module and a second signal module. When the first signal module has been mounted in the housing, the second signal module is guided and moved to mount into the housing by the guide groove of the second side of the second signal module receiving the guide projection of the first side of the first signal module; or, the second signal module is guided and moved to mount into the housing by the guide projection of the first side of the second signal module sliding into the guide groove of the second side of the first signal module.

According to another aspect of the present invention, before the signal modules are mounted in the housing, the first signal modules and the second signal modules are stacked side by side by combining the guide projection of the first side of each first signal module with the guide groove of the second side of the corresponding second signal module, and then the stacked first and second signal modules are mounted in the housing.

According to another aspect of the present invention, the conductive terminals of each signal module have a plurality of first contact sections and a plurality of second contact sections, wherein the first contact sections extend backward and outside a back side of the insulating body, and the second contact sections extend downward and outside a lower side of the insulating body. The ground shield has a plurality of first shield sections and a plurality of second shield sections, wherein the first shield sections extend backward and outside the insulating body to be corresponding to the first contact sections, and the second shield sections extend downward and outside the insulating body to be corresponding to the second contact sections.

According to another aspect of the present invention, the housing has a plurality of holes for receiving the first contact sections and the first shield sections. The housing has a tongue extending forward from a top side thereof, and the tongue has a plurality of windows disposed therethrough.

According to another aspect of the present invention, the insulating body of each signal module further includes a hook disposed on an upper side upper side of the insulating body. The hook of each signal module engages with the corresponding window of the housing so that the signal modules are mounted in the housing.

According to another aspect of the present invention, the guide groove of each signal module has a stop projection disposed on a bottom side thereof. The stop projection divides a space within the guide groove into a first groove portion and a second groove portion. The first groove portion has an opening for receiving the guide projection of another signal module to slide into the first groove portion. The guide projection continues to slide on the first groove portion until it climbs through the stop projection to enter the second groove portion.

According to another aspect of the present invention, the guide projection is a tight fit to the second groove portion.

According to another aspect of the present invention, the exposed guide projection of the outermost signal module mounted in the housing is removed.

It is remarked that the aforementioned aspects or features can also be combined with each other and are in the scope of the present invention as well.

By respectively disposing the guide projection and the guide groove on the first side and the second side of the insulating body of each signal module, the signal modules may be smoothly mounted in the housing, and therefore reduce relative movement between signal modules mounted in the housing without additional metal tie bars, resulting in increased assembly efficiency and reduced cost.

The foregoing, as well as additional objects, features and advantages of the present invention will be more readily apparent from the following embodiments and detailed description, which proceed with reference to the accompanying drawings.

DESCRIPTION OF THE PREFERRED EMBODIMENTS

Figure 1B:
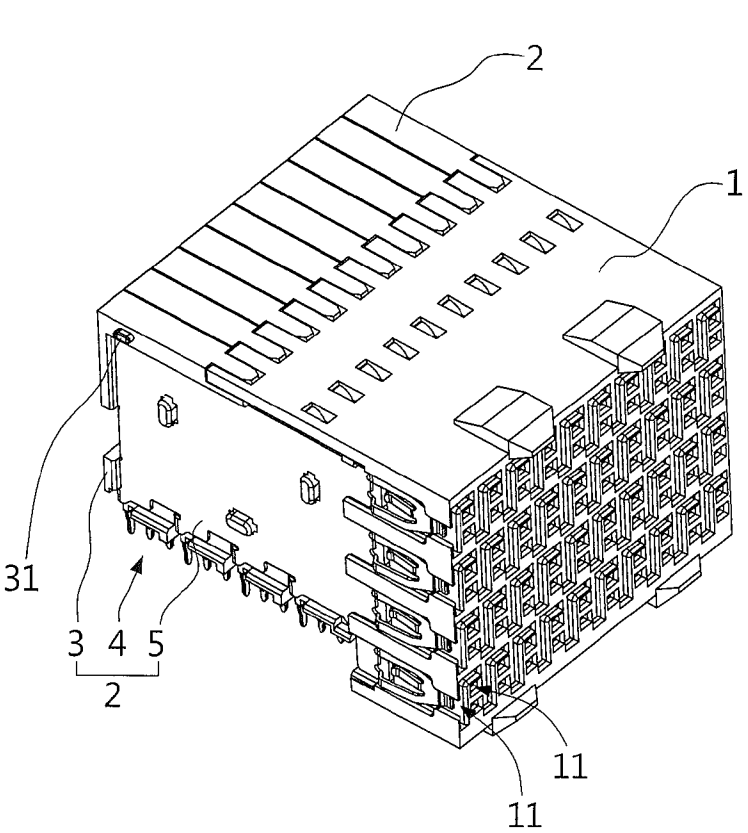
FIG. 1A and FIG. 1B are assembled diagrams of an electrical connector structure in different views according to a first embodiment of the present invention.

Reference will now be made in detail to several embodiments of the present invention that are illustrated in the accompanying drawings. Wherever possible, same or similar reference numerals are used in the drawings and the description to refer to the same or like parts. For purposes of convenience and clarity only, directional terms, such as up, down, left, right, front, and back may be used with respect to the drawings. These and similar directional terms should not be construed to limit the scope of the present invention in any manner.

Referring to FIGS. 1A, 1B, 2, 3A, 3B, and 4, there are illustrated an electrical connector according to a first embodiment of the present invention, which is, but not limited to, a ZD connector. In the first embodiment, the electrical connector structure includes a housing 1 and a plurality of signal modules 2 mounted in the housing 1. By way of example only, the electrical connector structure includes ten signal modules. Each of the signal modules 2 includes an insulating body 3, a plurality of conductive terminals 4, and a ground shield 5.

The insulating body 3 of each signal module 2 includes a first side 301 and a second side 302 opposite to the first side 301, wherein the first side 301 has a guide projection 31, and the second side 302 has a guide groove 32. The guide projection 31 may be a cylinder, a rectangular prism, or any other type of shape. The guide groove 32 has a stop projection 321 disposed on a bottom side of the guide groove 32. The stop projection 321 divides a space within the guide groove 32 into a first groove portion 322 and a second groove portion 323. The first groove portion 322 has an opening for receiving the guide projection of another signal module 2 to slide into the first groove portion 322. After the guide projection slides into the first groove portion 322, it continues to slide on the first groove portion 322 until it climbs through the stop projection 321 to enter the second groove portion 323, of which detailed description will be given later with reference to FIGS. 5, 6, and 7. In addition, the insulating body 3 further includes a hook 33 disposed on an upper side 305 of the insulating body 3.

The conductive terminals 4 of each signal module 2 are disposed in the insulating body 3. In the first embodiment, the conductive terminals 4 are disposed in the insulating body 3 in an insert molding manner, but it is not limited to this manner. For example, the conductive terminals may be disposed in the insulating body in an assembly manner. The conductive terminals 4 of each signal module 2 have a plurality of first contact sections 41 and a plurality of second contact sections 42, wherein the first contact sections 41 extend backward and outside a back side 303 of the insulating body 3, and the second contact sections 42 extend downward and outside a lower side 304 of the insulating body 3.

The ground shield 5 of each signal module 2 is mounted on the first side 301 of the insulating body 3, but it is not limited to this side. For example, the ground shield may be mounted on the second side of the insulating body. The ground shield 5 has a plurality of first shield sections 51 and a plurality of second shield sections 52, wherein the first shield sections 51 extend backward and outside the insulating body 3 to be corresponding to the first contact sections 41, and the second shield sections 52 extend downward and outside the insulating body 3 to be corresponding to the second contact sections 42.

In the first embodiment, when the signal modules 2 have been mounted in the housing 1, one ground shield 5 is positioned between conductive terminals 4 of two adjacent signal modules 2, one first shield section 51 is positioned between first contact sections 41 of two pair of adjacent conductive terminals 4 of two adjacent signal modules 2, and one second shield section 52 is positioned between second contact sections 42 of two pair of adjacent conductive terminals 4 of one signal module 2, thereby reducing signal crosstalk.

The housing 1 has a plurality of holes 11 for receiving the first contact sections 41 of the conductive terminals 4 and the first shield sections 51 of the ground shields 5. The housing 1 has a tongue 12 extending forward from a top side of the housing 1, and the tongue 12 has a plurality of windows 13 disposed through the tongue 12. The hook 33 of each signal module 2 engages with the corresponding window 13 of the housing 1 so that signal modules 2 may be mounted in the housing 1.

In the first embodiment, the electrical connector is a female (or receptacle) connector, which may be electrically connected with a male (or header) connector to form an electrical connector assembly. The electrical connector assembly may be electrically connected between two printed circuit boards (PCBs), or between a PCB and conducting wires. In one embodiment, the first contact sections 41 and the first shield sections 51 of the female connector are inserted into front openings of the holes 11, and back openings of the holes 11 receive pins of the male connector disposed on a PCB to insert, so that the first contact sections 41 and the first shield sections 51 of the female connector may be electrically connected with the pins of the male connector, respectively. In another embodiment, the first contact sections 41 and the first shield sections 51 of the female connector may be, via the holes 11, electrically connected with the pins of the male connector to form an electrical connector assembly, and then the electrical connector assembly may be electrically connected with conducting wires; moreover, the second contact sections 42 and the second shield sections 52 of the female connector may be electrically connected with another PCB, wherein the first shield sections 51 and the second shield sections 52 should be electrically connected to the ground.

Figure 5:
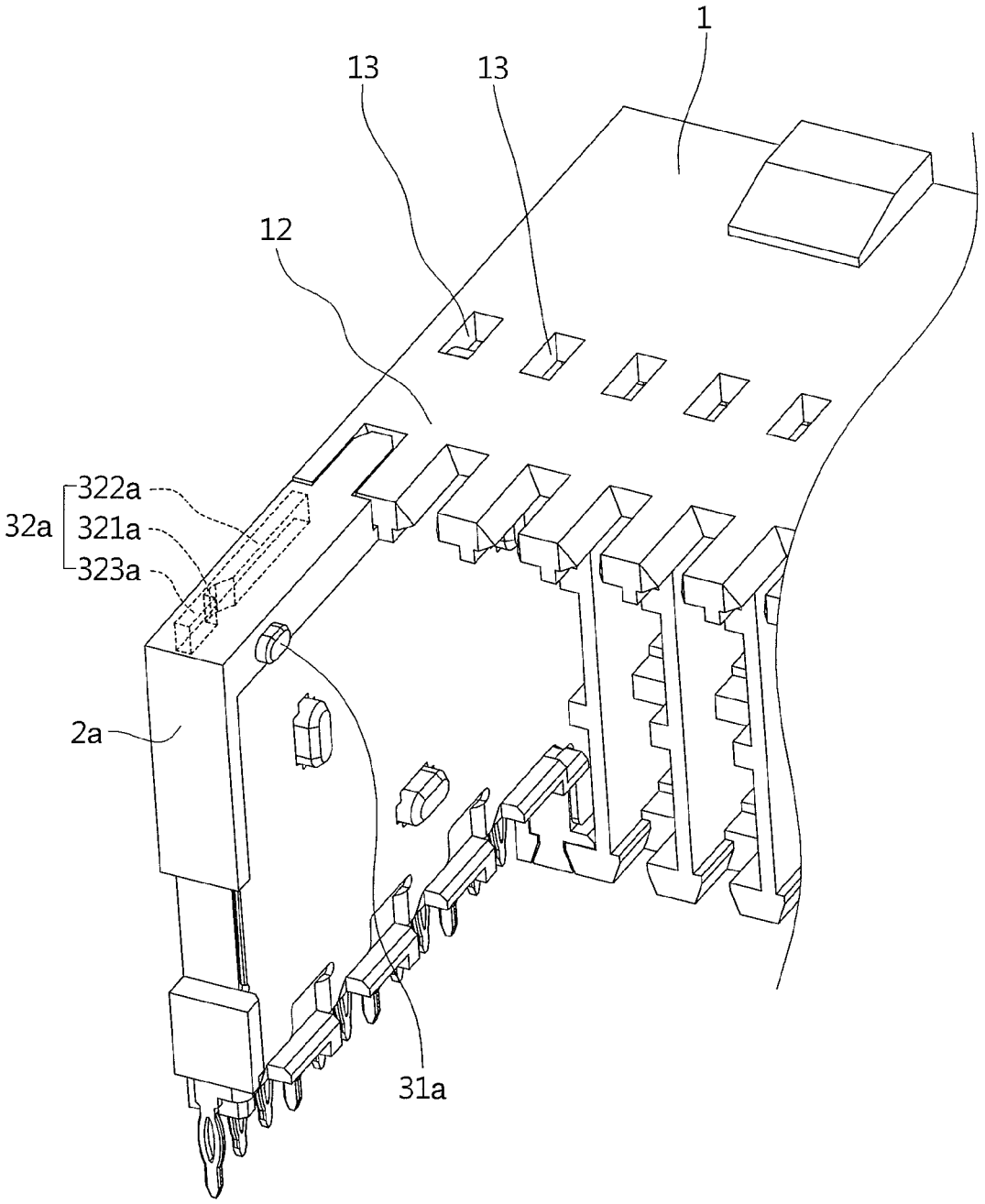
FIGS. 5, 6, and 7 are diagrams showing steps of mounting signal modules in a housing according to the first embodiment of the present invention.
Figure 6:
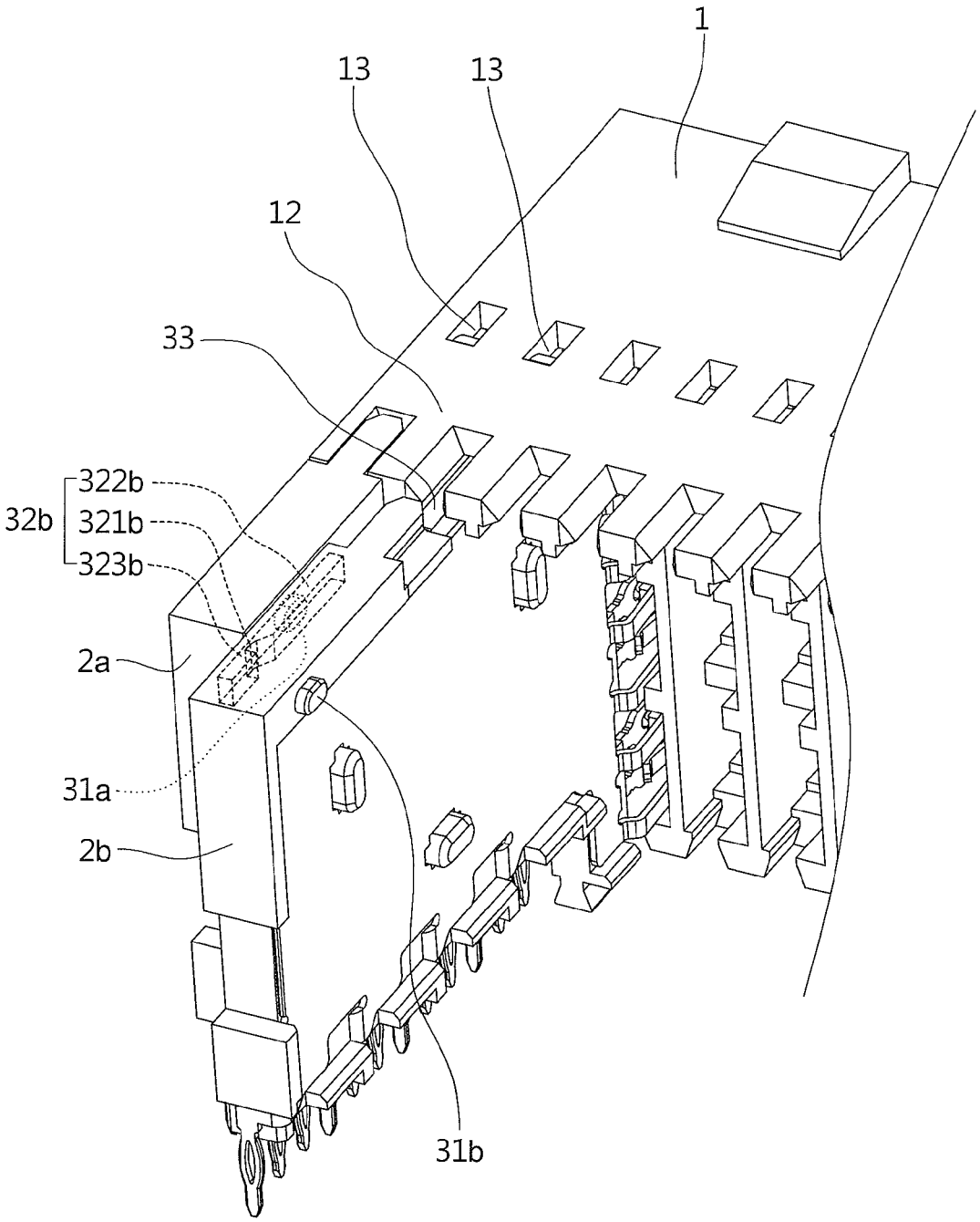
Figure 7:
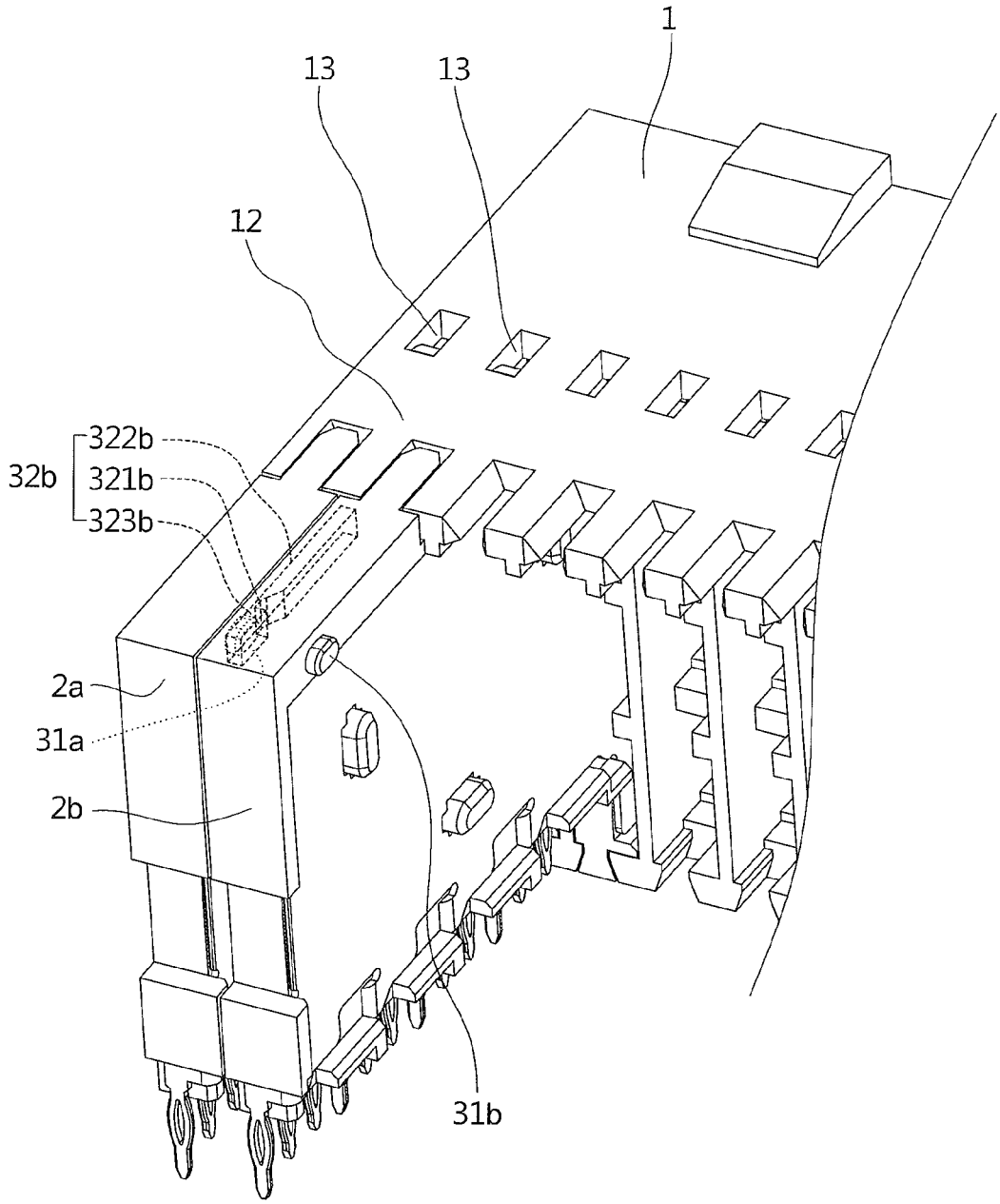

Referring to FIGS. 5, 6, and 7, there are illustrated steps of mounting the signal modules 2 in the housing 1 according to the first embodiment of the present invention. A first signal module 2*a* and a second signal module 2*b* of the signal modules 2 are taken as an example, but it is not limited to these signal modules. For example, the steps may be applied to any two signal modules 2. When the first signal module 2*a* has been mounted in the housing 1 (as shown in FIG. 5), the second signal module 2*b* moves close to the first signal module 2*a*, and then an opening of the first groove portion 322*b* of the guide groove 32*b* of the second side of the second signal module 2*b* receives the guide projection 31*a* of the first side of the first signal module 2*a* (as shown in FIG. 6). Because the guide groove 32*b* and the guide projection 31*a* may limit their movements to each other, when the second signal module 2*b* continues to move backward, the guide projection 31*a* of the first signal module 2*a* continues to slide on the first groove portion 322*b* until the guide projection 31*a* climbs through the stop projection 321*b* to enter the second groove portion 323*b* (as shown in FIG. 7). When the guide projection 31*a* of the first signal module 2*a* enters the second groove portion 323*b* of the second signal module 2*b*, the second signal module 2*b* has just finished mounting in the housing 1. Therefore, the second signal module 2*b* is guided by the guide groove 32*b* and the guide projection 31*a*, and then moved to mount into the housing 1. In one embodiment, the guide projection 31*a* of the first signal module 2*a* may be a tight fit to the second groove portion 323*b* of the second signal module 2*b*.

While the second signal module 2*b* continues to move backward, the hook 33 of the second signal module 2*b* touches a front edge of the tongue 12 of the housing 1 and then engages with the corresponding window 13 disposed through the tongue 12. Because the guide groove 32*b* and the guide projection 31*a* may limit their movements to each other, the second signal module 2*b* doesn't rotate when its hook 33 touches the front edge of the tongue 12 so that the second signal module 2*b* may continue to smoothly move to mount into the housing 1, resulting in increased assembly efficiency and reduced assembly cost. Moreover, because the guide groove 32*b* and the guide projection 31*a* may limit their movements to each other, when the first signal module 2*a* and the second signal module 2*b* have been mounted in the housing 1, the two signal modules 2*a* and 2*b* may have reduced relative movement therebetween in the housing 1 without additional metal tie bars, and result in reduced cost.

The aforementioned assembly method of the electrical connector as shown in FIGS. 5, 6, and 7 is mounting the signal modules 2 one by one in the housing 1, but it is not limited to this assembly method. For example, the assembly method may be stacking all of the signal modules 2 side by side and then mounting the stacked signal modules 2 in the housing 1 because any two signal modules 2 may be combined together by concave and convex structures like the guide projection 31 and the guide groove 32. In one embodiment according to the latter assembly method, any two signal modules 2*a* and 2*b* may be stacked side by side by guiding to each other as shown in FIGS. 5, 6, and 7, and then the stacked signal modules 2*a* and 2*b* are mounted in the housing 1. In another embodiment according to the latter assembly method, any two signal modules 2*a* and 2*b* may be stacked side by side by directly inserting the guide projection 31*a* of each first signal module 2*a* into the second groove portion 323*b* of the guide groove 32*b* of the corresponding second signal module 2*b*, and then the stacked signal modules 2*a* and 2*b* are mounted in the housing 1.

In one embodiment, compared with the first signal module 2*a* and the second signal module 2*b* as shown in FIG. 6, the guide projections of the first and the second signal modules are disposed on the left sides (the first sides), and the guide grooves of the first and the second signal modules are disposed on the right sides (the second sides). Therefore, when the first signal module has been mounted in the housing, the second signal module is guided and moved to mount into the housing by the guide projection of the left side (the first side) of the second signal module sliding into the guide groove of the right side (the second side) of the first signal module.

Figure 1A:
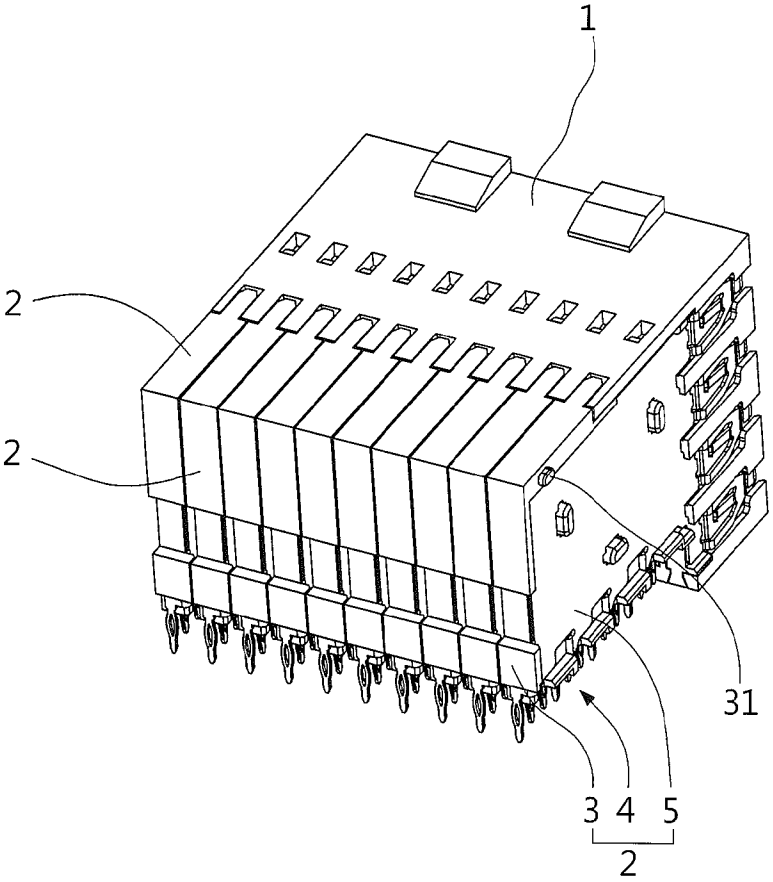
Figure 2:
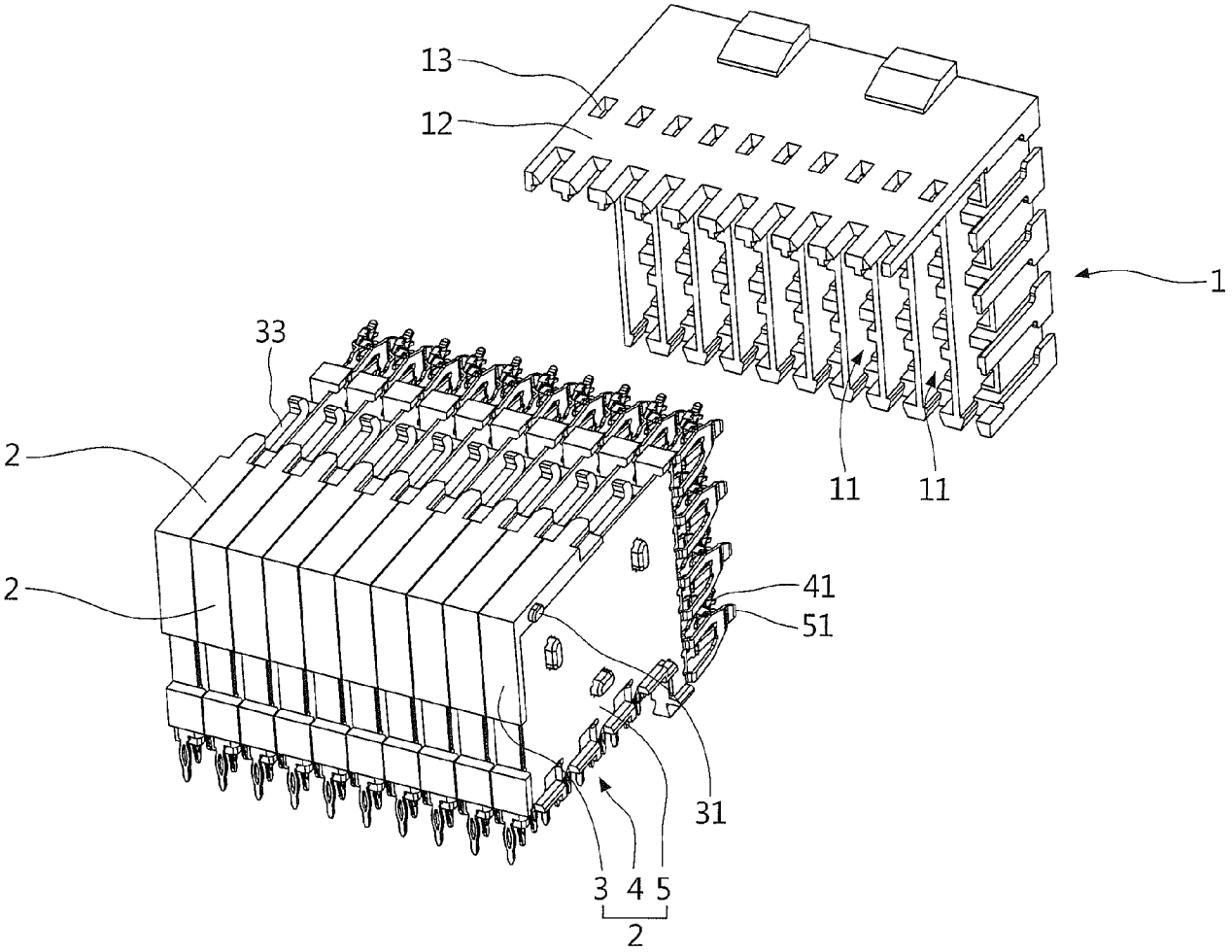
FIG. 2 is a partially exploded diagram of the electrical connector structure according to the first embodiment of the present invention.
Figure 3A:
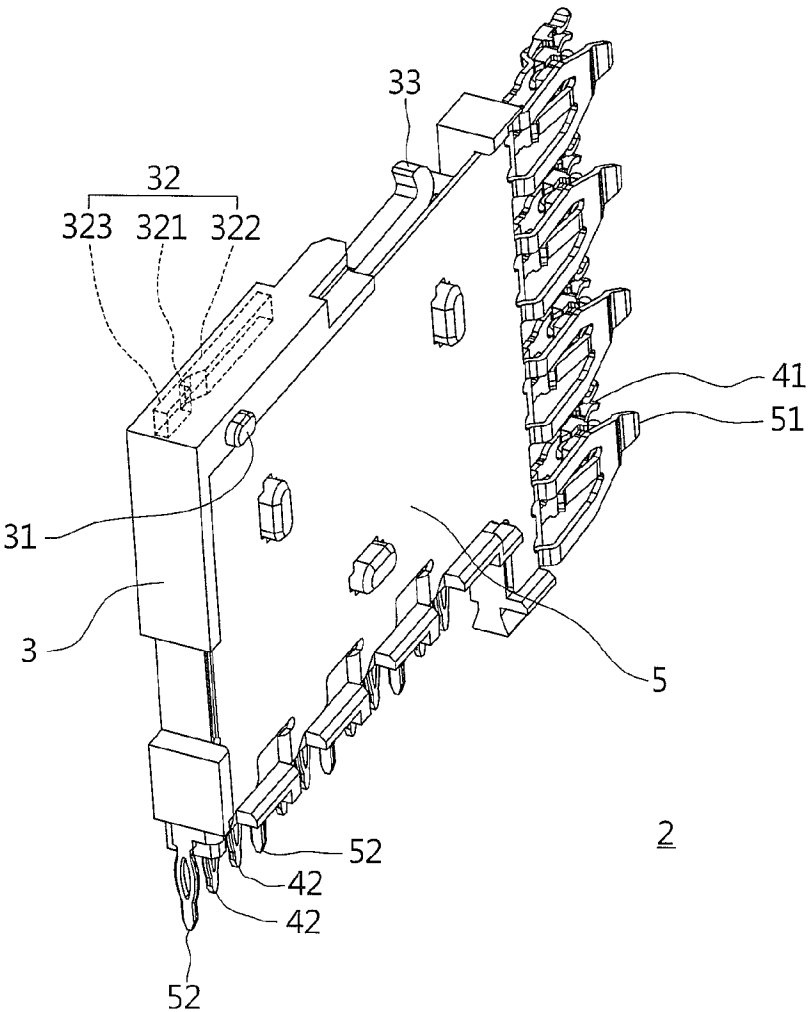
FIG. 3A and FIG. 3B are assembled diagrams of a signal module according to the first embodiment of the present invention.
Figure 3B:
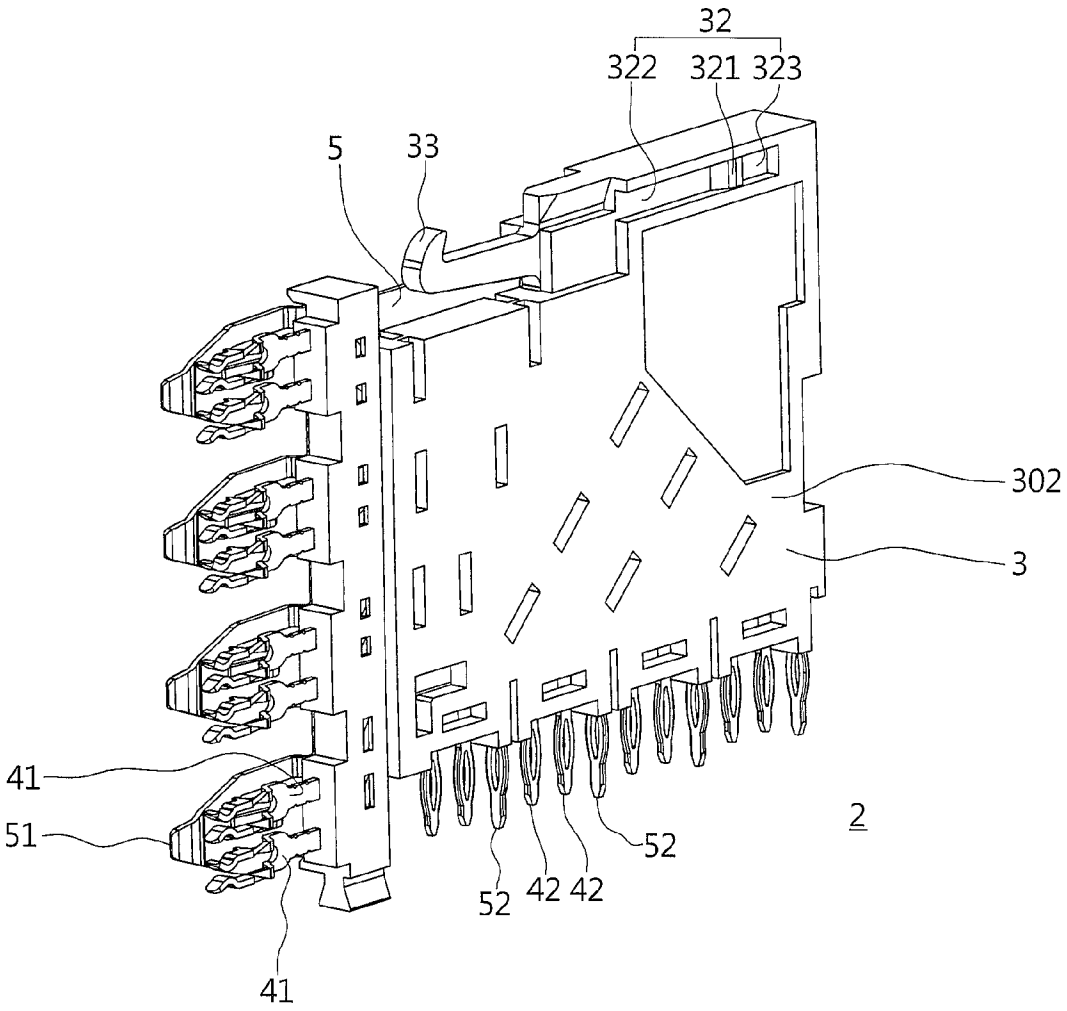
Figure 4:
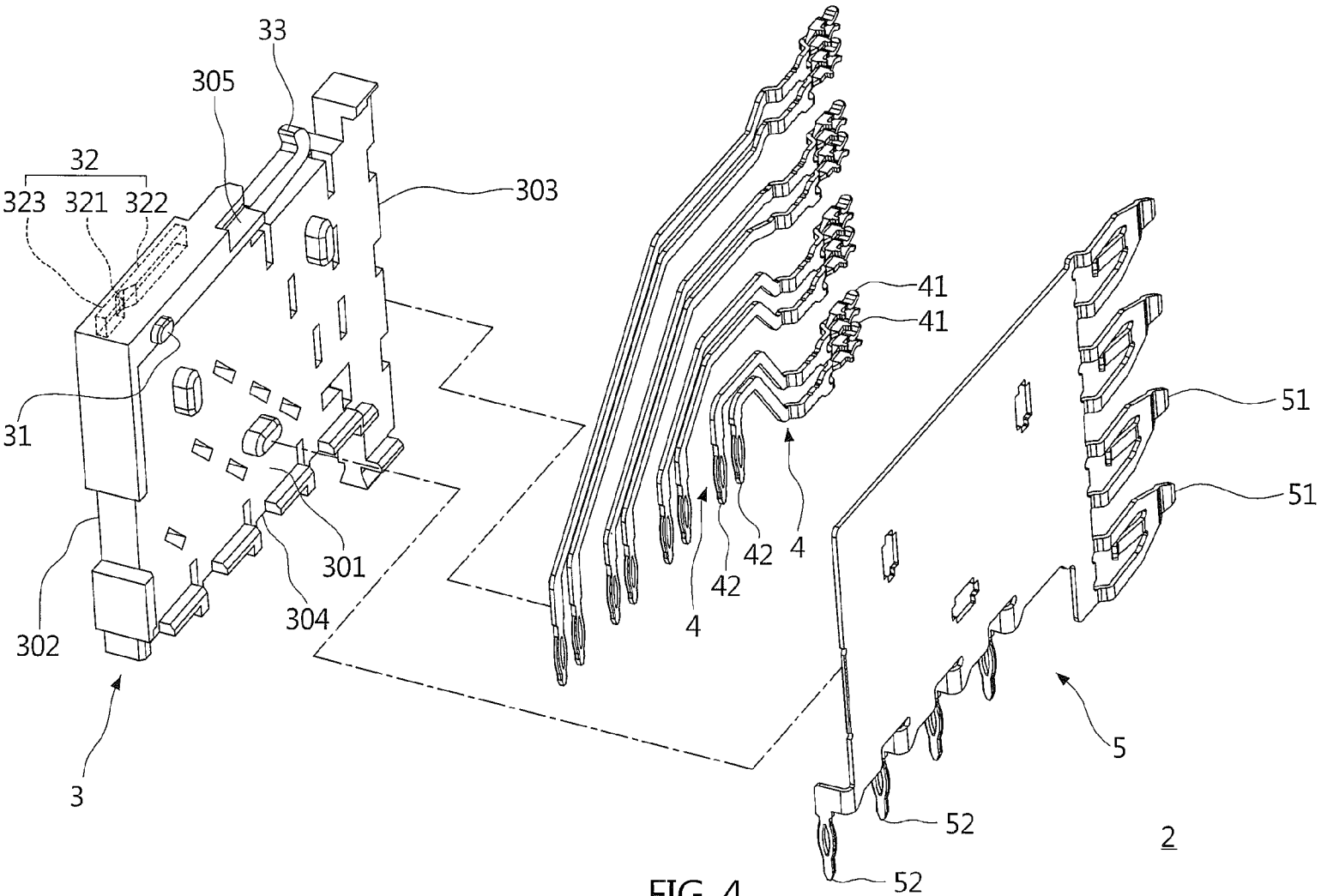
FIG. 4 is an exploded diagram of a signal module according to the first embodiment of the present invention.

In one embodiment, the exposed guide projection 31 of the outermost signal module 2 mounted in the housing 1, as shown in FIGS. 1A, 1B, and 2, may be removed so that the electrical connector structure has a smoother appearance.

Figure 8:
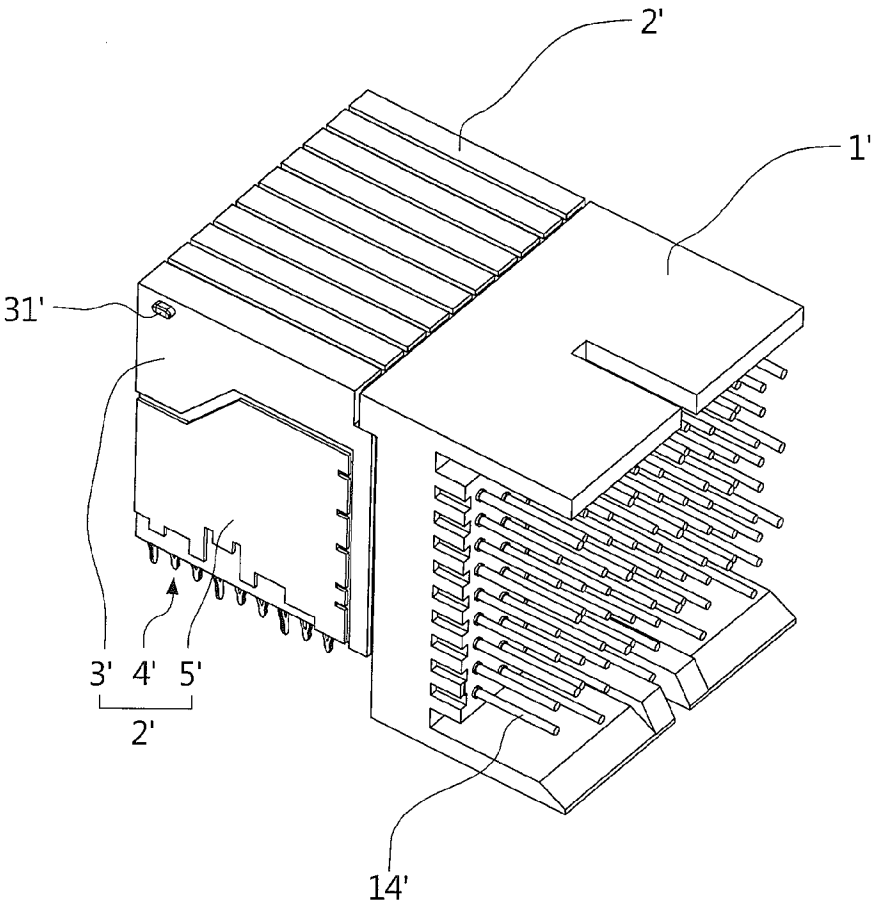
FIG. 8 is an assembled diagram of an electrical connector structure according to a second embodiment of the present invention.

Although the electrical connector in the first embodiment is a female connector, it is not limited to this type of connector. For example, the electrical connector may be designed to be a male connector. Referring to FIG. 8, there is illustrated an electrical connector structure according to a second embodiment of the present invention. In the second embodiment, the electrical connector is a male connector, which may be electrically connected with a female connector to form an electrical connector assembly. The electrical connector assembly may be electrically connected between two PCBs, or between a PCB and conducting wires. In the second embodiment, the electrical connector structure includes a housing 1' and a plurality of signal modules 2' mounted in the housing 1'. Each of the signal modules 2' includes an insulating body 3', a plurality of conductive terminals 4', and a ground shield 5'. Like the signal module 2 in the first embodiment, the signal module 2' in the second embodiment also has a first side having a guide projection 31', and a second side having a guide groove (not shown), and therefore any two signal module 2 ' may be combined together by concave and convex structures like the guide projection and the guide groove so as to reduce relative movement between signal modules 2' mounted in the housing 1' without additional metal tie bars, resulting in reduced cost. Compared with the housing 1 in the first embodiment, the housing 1' in the second embodiment also has a plurality of holes (not shown); however, front openings of the holes are used for receiving first contact sections (not shown) of the conductive terminals 4' and first shield sections (not shown) of the ground shields 5' to insert, and back openings of the holes have pins 14' pre-inserted therein. Therefore, when the signal modules 2' are mounted in the housing 1', the first contact sections of the conductive terminals 4' and the first shield sections of the ground shields 5' insert the holes to be electrically connected with the pins 14'.

It will be apparent to those skilled in the art that various modifications and variations can be made to the structure of the present invention without departing from the scope or spirit of the present invention. In view of the foregoing, it is intended that the present invention cover modifications and variations of this invention provided they fall within the scope of the following claims and their equivalents.

What is claimed is:

1. An electrical connector structure comprising:

a housing; and a plurality of signal modules mounted in the housing, each of the signal modules comprising an insulating body, a plurality of conductive terminals, and a ground shield, the insulating body having a first side and a second side opposite thereto, the first side having a guide projection, the second side having a guide groove, the conductive terminals being disposed in the insulating body, the ground shield being mounted on the first side or the second side of the insulating body;

wherein, the signal modules comprise a first signal module and a second signal module, when the first signal module has been mounted in the housing, the second signal module is guided and moved to mount into the housing by the guide groove of the second side of the second signal module receiving the guide projection of the first side of the first signal module; or, the second signal module is guided and moved to mount into the housing by the guide projection of the first side of the second signal module sliding into the guide groove of the second side of the first signal module.

2. The electrical connector structure of claim 1, wherein the conductive terminals of each signal module have a plurality of first contact sections and a plurality of second contact sections, wherein the first contact sections extend backward and outside a back side of the insulating body, and the second contact sections extend downward and outside a lower side of the insulating body.

3. The electrical connector structure of claim 2, wherein the ground shield has a plurality of first shield sections and a plurality of second shield sections, wherein the first shield sections extend backward and outside the insulating body to be corresponding to the first contact sections, and the second shield sections extend downward and outside the insulating body to be corresponding to the second contact sections.

4. The electrical connector structure of claim 3, wherein the housing has a plurality of holes for receiving the first contact sections and the first shield sections.

5. The electrical connector structure of claim 4, wherein the housing has a tongue extending forward from a top side thereof, and the tongue has a plurality of windows disposed therethrough.

6. The electrical connector structure of claim 5, wherein the insulating body of each signal module further comprises a hook disposed on an upper side upper side of the insulating body, and the hook of each signal module engages with the corresponding window of the housing so that the signal modules are mounted in the housing.

7. The electrical connector structure of claim 1, wherein the guide groove of each signal module has a stop projection disposed on a bottom side thereof, the stop projection divides a space within the guide groove into a first groove portion and a second groove portion, the first groove portion has an opening for receiving the guide projection of another signal module to slide into the first groove portion, the guide projection continues to slide on the first groove portion until it climbs through the stop projection to enter the second groove portion.

8. The electrical connector structure of claim 7, wherein the guide projection is a tight fit to the second groove portion.

9. The electrical connector structure of claim 1, wherein the exposed guide projection of the outermost signal module mounted in the housing is removed.

10. The electrical connector structure of claim 1, wherein before the signal modules are mounted in the housing, the first signal modules and the second signal modules are stacked side by side by combining the guide projection of the first side of each first signal module with the guide groove of the second side of the corresponding second signal module, and then the stacked first and second signal modules are mounted in the housing.

11. The electrical connector structure of claim 10, wherein the conductive terminals of each signal module have a plurality of first contact sections and a plurality of second contact sections, wherein the first contact sections extend backward and outside a back side of the insulating body, and the second contact sections extend downward and outside a lower side of the insulating body.

12. The electrical connector structure of claim 11, wherein the ground shield has a plurality of first shield sections and a plurality of second shield sections, wherein the first shield sections extend backward and outside the insulating body to be corresponding to the first contact sections, and the second shield sections extend downward and outside the insulating body to be corresponding to the second contact sections.

13. The electrical connector structure of claim 12, wherein the housing has a plurality of holes for receiving the first contact sections and the first shield sections.

14. The electrical connector structure of claim 13, wherein the housing has a tongue extending forward from a top side thereof, and the tongue has a plurality of windows disposed therethrough.

15. The electrical connector structure of claim 14, wherein the insulating body of each signal module further comprises a hook disposed on an upper side upper side of the insulating body, and the hook of each signal module engages with the corresponding window of the housing so that the signal modules are mounted in the housing.

16. The electrical connector structure of claim 10, wherein the guide groove of each signal module has a stop projection disposed on a bottom side thereof, the stop projection divides a space within the guide groove into a first groove portion and a second groove portion, the first groove portion has an opening for receiving the guide projection of another signal module to slide into the first groove portion, the guide projection continues to slide on the first groove portion until it climbs through the stop projection to enter the second groove portion.

17. The electrical connector structure of claim 16, wherein the guide projection is a tight fit to the second groove portion.

18. The electrical connector structure of claim 10, wherein the exposed guide projection of the outermost signal module mounted in the housing is removed.

* * * * *